US011560734B2

(12) United States Patent
Blackett

(10) Patent No.: US 11,560,734 B2
(45) Date of Patent: Jan. 24, 2023

(54) DECORATIVE PANEL KIT

(71) Applicant: Roderick Blackett, Riverview, FL (US)

(72) Inventor: Roderick Blackett, Riverview, FL (US)

( * ) Notice: Subject to any disclaimer, the term of this patent is extended or adjusted under 35 U.S.C. 154(b) by 188 days.

(21) Appl. No.: 17/072,487

(22) Filed: Oct. 16, 2020

(65) Prior Publication Data

US 2022/0120111 A1 Apr. 21, 2022

(51) Int. Cl.
*E04H 17/16* (2006.01)
*B41J 3/28* (2006.01)

(52) U.S. Cl.
CPC ..... *E04H 17/166* (2013.01); *B41J 3/28* (2013.01)

(58) Field of Classification Search
CPC ..... B41J 3/28; E04H 17/166
See application file for complete search history.

(56) References Cited

U.S. PATENT DOCUMENTS 4,842,036 A 6/1989 Goodman
5,263,529 A 11/1993 Landis
6,685,172 B2 2/2004 Jolliffe
10,053,910 B2 8/2018 Avinger
2002/0011594 A1* 1/2002 DeSouza ..... E04H 17/16 256/19
2005/0194106 A1* 9/2005 Scales ..... E05D 15/24 160/201
2006/0033092 A1* 2/2006 Camacho ..... E04H 17/1408 256/32
2016/0047140 A1* 2/2016 Knudsen ..... E04H 17/165 29/428
2017/0140255 A1* 5/2017 Norasak ..... G06K 15/021
2019/0055751 A1* 2/2019 Jackson ..... E04H 17/165
2019/0145125 A1* 5/2019 Carter ..... E04H 17/168 256/31

* cited by examiner

*Primary Examiner* — Jennifer Bahls
*Assistant Examiner* — Quang X Nguyen
(74) *Attorney, Agent, or Firm* — David L. King

(57) ABSTRACT

A decorative panel kit for privacy fences has a plurality of panels. Each panel has a portion of an image imprinted on an exterior surface. Upon assembly to a privacy fence section, the assembled plurality of panels has adjacent panels each with the portion of the image aligned to depict a complete image. Each panel is sized with a length (L) extending from a first end to a second end and portions of the length adjacent the ends are configured to fit into a space formed in a privacy fence section between extending members and fence boards. The extending members include a first member and a second member. The first and second members hold a plurality of fence boards to form the privacy fence sections. The end portions of the length of each panel are held in the space between the first and second members and the fence boards.

14 Claims, 9 Drawing Sheets

DECORATIVE PANEL KIT

TECHNICAL FIELD

The present invention relates to a decorative panel kit for privacy fences. More particularly, to a plurality of discrete panels that have a full image or design pattern on assembly.

BACKGROUND OF THE INVENTION

The use of art or signage on the exterior of buildings or walls is a common practice. At sporting venues like baseball fields, fences or walls often carry advertising. Typically, these signs are made of flexible waterproof material on a large single panel with an image of the advertiser's choice. These signs are expensive to make and generally not particularly durable in sever weather conditions. The introduction of residential or commercial privacy fences has become popular. These privacy fences are often made of durable plastic. They commonly have plastic posts anchored to a buried post or cemented in a hole with fence panel sections between and secured to the posts. The fence panel sections have a pair of members to hold fence boards in place. The members get fastened to the posts and generally extend horizontally between the posts. The members have a cross section, typically "U" shaped, into which the fence boards slide to form the fence panel section. The fence boards are typically oriented lengthwise vertically relative to the ground and parallel to the posts. Alternatively, the fence boards could be oriented horizontally relative to the ground. This is less common, but for purposes of the present invention, the decorative panel kit described herein can work with either configuration.

The present invention provides a unique panel kit with a decorative image made with a unique method of manufacture of the kit and of application of the kit to a section of privacy fence.

SUMMARY OF THE INVENTION

A decorative panel kit for privacy fences has a plurality of panels. Each panel has a portion of an image imprinted on an exterior surface. Upon assembly to a privacy fence section, the assembled plurality of panels has adjacent panels each with the portion of the image aligned to depict a complete image. Each panel is a rectangular sheet of material having a length, a width, edges and a thickness. Each panel is sized with a length (L) extending from a first end to a second end and portions of the length adjacent the ends are configured to fit into a space formed in a privacy fence section between extending members and fence boards. The extending members include a first member and a second member. The first and second members hold a plurality of fence boards to form the privacy fence sections. The end portions of the length of each panel are held in the space between the first and second members and the fence boards.

The rectangular sheet is flat. The thickness of the rectangular sheet is 3.0 mm. The kit further can have an adhesive double-sided tape or an adhesive glue configured to adhere an interior surface of the panels to the fence boards.

A method of manufacturing a decorative panel kit for privacy fences has the steps of: providing a thin sheet of panel material and cutting the panel material into a plurality of panels, each panel having a width, a length, and a thickness; aligning the panels along their respective lengths to form a first plurality of adjacent panels; holding the first plurality of adjacent panels and either passing the first plurality of adjacent panels through a flatbed printer or passing the flatbed printer over the held first plurality of adjacent panels; and printing a full image or at least a first portion of an image on an exterior surface of the first plurality of adjacent panels.

The method further has the steps of: providing additional panels having the width, the length, and thickness; aligning the additional panels along their respective lengths to form a second plurality of adjacent panels; holding the second plurality of adjacent cut panels and passing through a flatbed printer or passing the flatbed printer over the held second plurality of adjacent panels; and printing a second portion of the image on an exterior surface of the second plurality of adjacent panels. The second portion of the image complimentarily forms a complete image when aligned with the printed exterior surface of the first plurality of adjacent panels. The steps of providing additional panels can be repeated to allow complete images of larger sizes to be made. The panels, after printing, are assembled and packaged to form a decorative panel kit. The method further may have the step of applying an adhesive coating or double-sided tape to an interior surface of each panel opposite the surface with the printed image and covering the adhesive with a releasable film prior to packaging the decorative panel kit.

A method of affixing a decorative panel kit for a privacy fence has the steps of: providing a decorative panel kit having a plurality of panels with portions of an image printed on each panel of the plurality of panels configured to form a complete image when the panels are placed adjacently; placing a first end of a panel of the plurality of panels in a space between a first member holding fence boards of a privacy fence section and the fence boards and placing a second end of the panel in a space between a second member holding the fence boards and the fence boards wherein the portion of the image is exterior relative to the fence boards and visible; and repeating by placing a next panel adjacent a previous panel with the first and second ends held in the spaces until all the panels are positioned onto and secured to the privacy fence section with the complete image being formed by the assembly of the plurality of panels. The method further has centering the image by locating a center of the privacy fence section, taking a first panel of the plurality of panels and positioning a leading edge of the first panel a distance of half the width of the entire panel kit from the center on a fence board of the privacy fence section so a center of the complete image will substantially align with the center of the privacy fence section. The step of placing the ends of the panels between the members holding the fence boards and the fence boards further has the step of positioning the ends in the space between the member and the fence board thereby holding each panel and the panels have a thickness configured to fit into the space. The method further has the step of holding the panels at the ends and wherein an interior surface of the panel lies against the fence board. The method further has the step of providing the interior surface of each panel with an adhesive or applying an adhesive to an interior surface of each panel and pressing the panel against the fence board to adhesively hold the panel against the fence board. The adhesive can be a spray on or double-sided tape. Preferably, the panels are held at each end and between the ends along at least portions of the interior surface by adhesives. The panels can be oriented parallel to the fence boards and transverse to the members of the privacy fence. The panels and fence boards can be oriented vertically relative to the privacy fence.

BRIEF DESCRIPTION OF THE DRAWINGS

The invention will be described by way of example and with reference to the accompanying drawings in which.

DETAILED DESCRIPTION OF THE INVENTION

Figure 1:
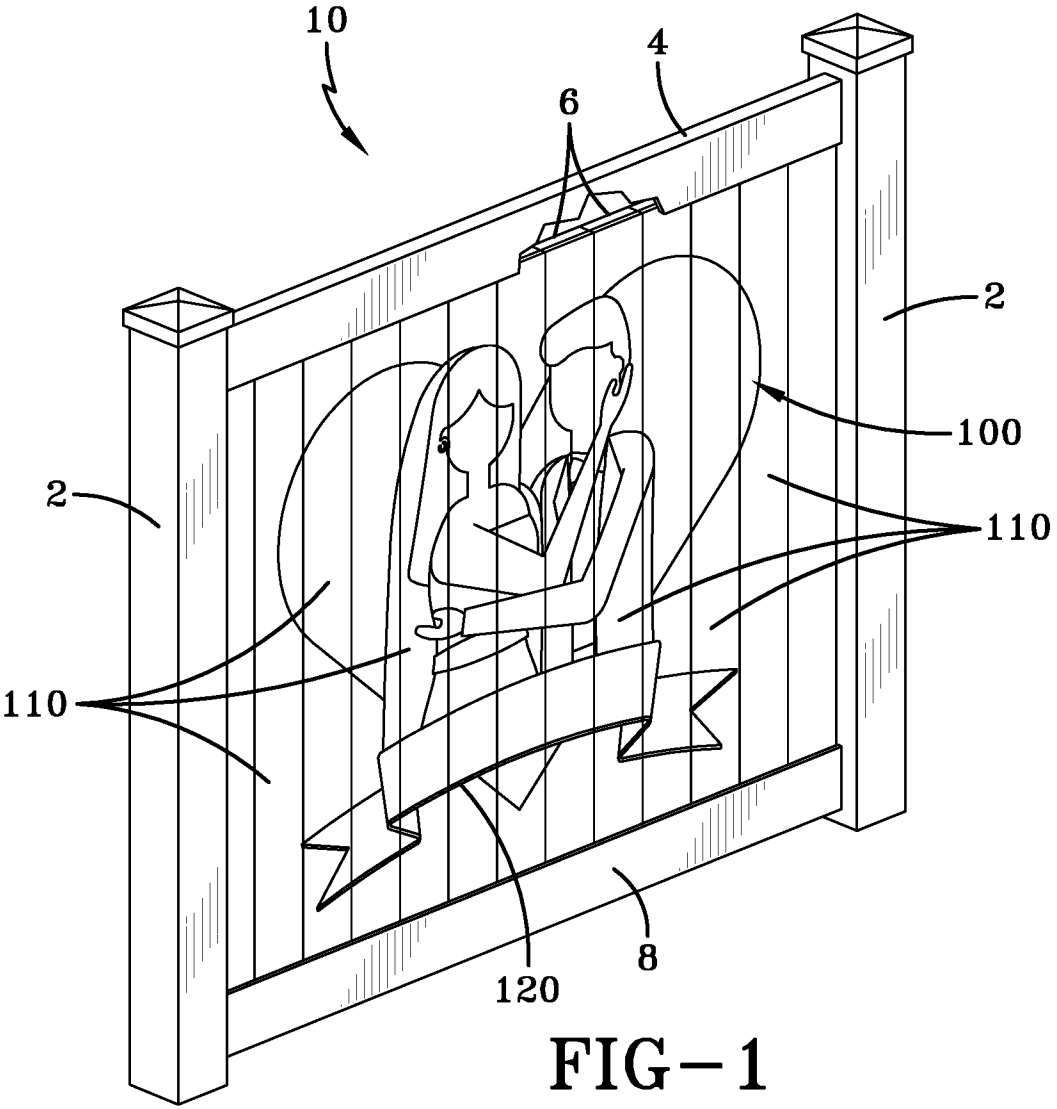
FIG. 1 is a perspective view of the decorative panel kit assembled and placed on a section of a privacy fence according to the present invention.
Figure 2:
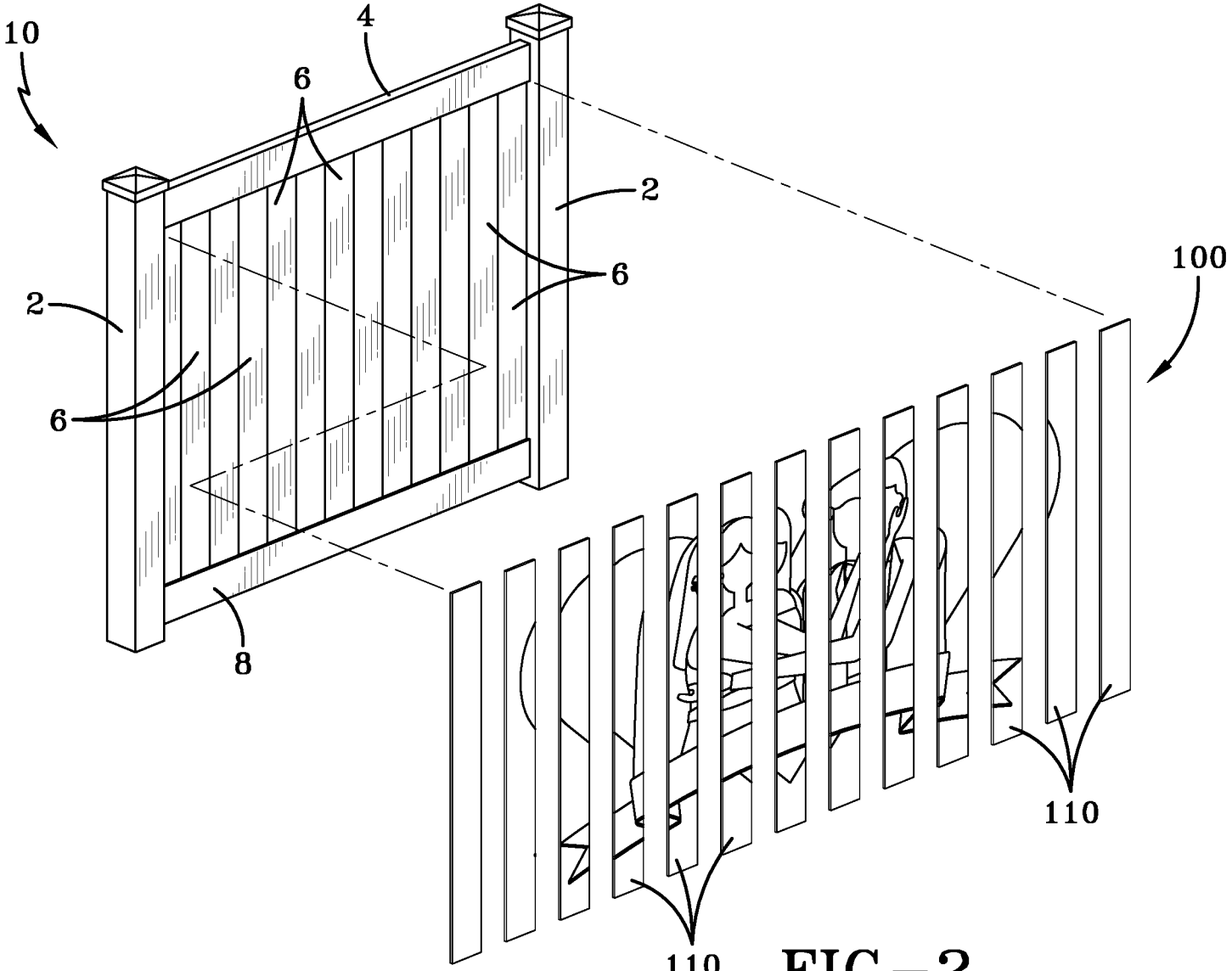
FIG. 2 is an exploded perspective view of the decorative panel kit and an exemplary privacy fence section.

With reference to FIGS. 1-9, a decorative panel kit for privacy fences is illustrated. The kit 100 has a plurality of panels 110, each panel 110 has a portion of an image 120 imprinted on the exterior surface whereupon assembly to a privacy fence section 10, the assembled plurality of panels have adjacent panels 110 each with the portion of the image aligned to depict a complete image 120 as shown in FIG. 1. With reference to FIG. 1, the kit 100 has been placed on a section 10 of a privacy fence. This is best illustrated in FIG. 2 wherein the kit 100 is shown with the plurality of panels 110 spaced apart and oriented facing the fence boards 6 of the privacy fence section 10 to which the decorative kit 100 is to be assembled.

Figure 3:
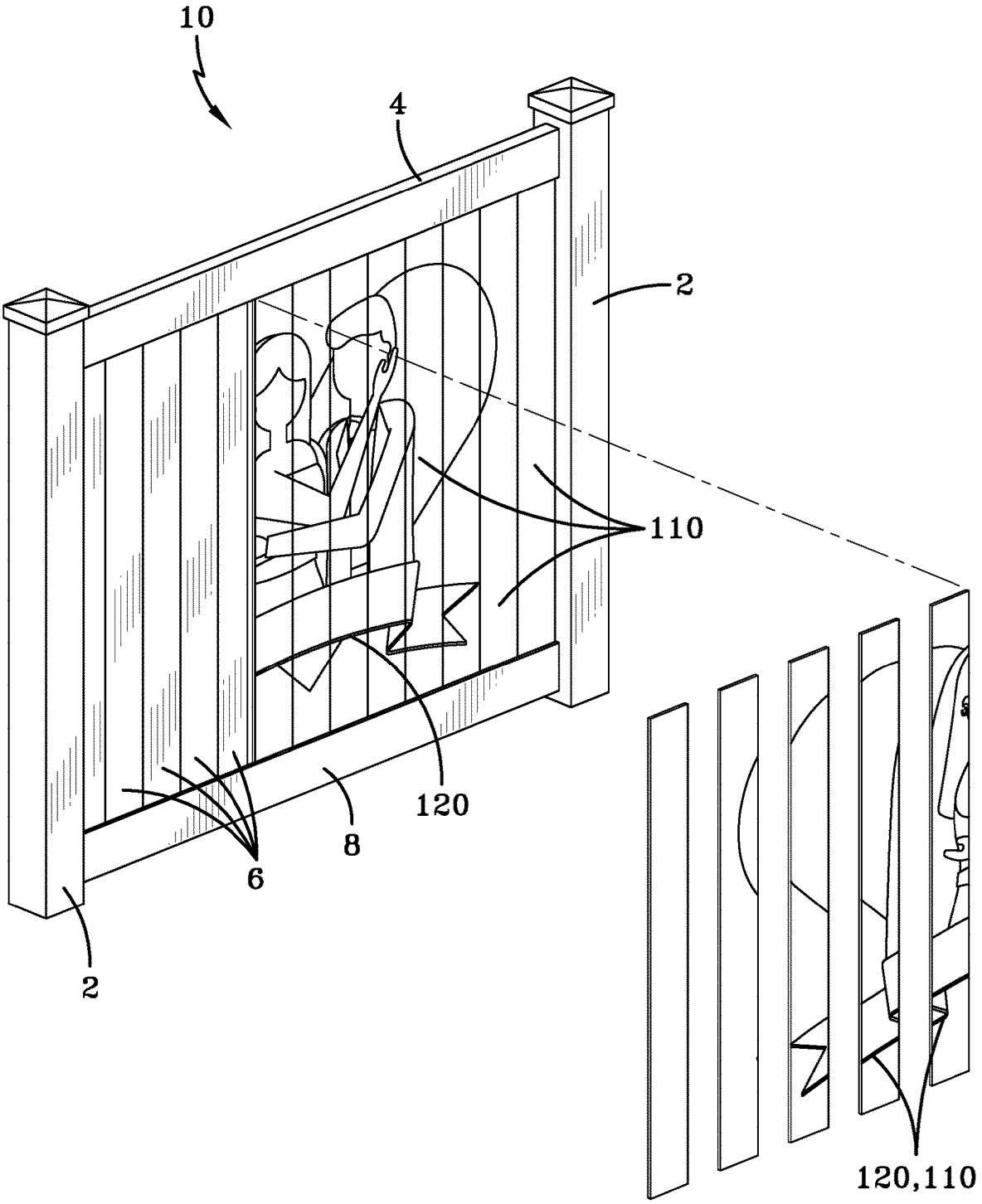
FIG. 3 is a perspective view with a portion of the kit placed on the exemplary privacy fence section with several of the panels to be sequentially placed to complete the decorative image.

With reference to FIG. 3, the assembly is shown wherein some of the panels 110 are already positioned into the privacy fence section 10 and the remaining portion of the panels 110 are shown to be added. These panels 110, when added to the privacy fence section 10 will complete the entire image 120 depicted on the decorative panel kit 100.

Figure 4:
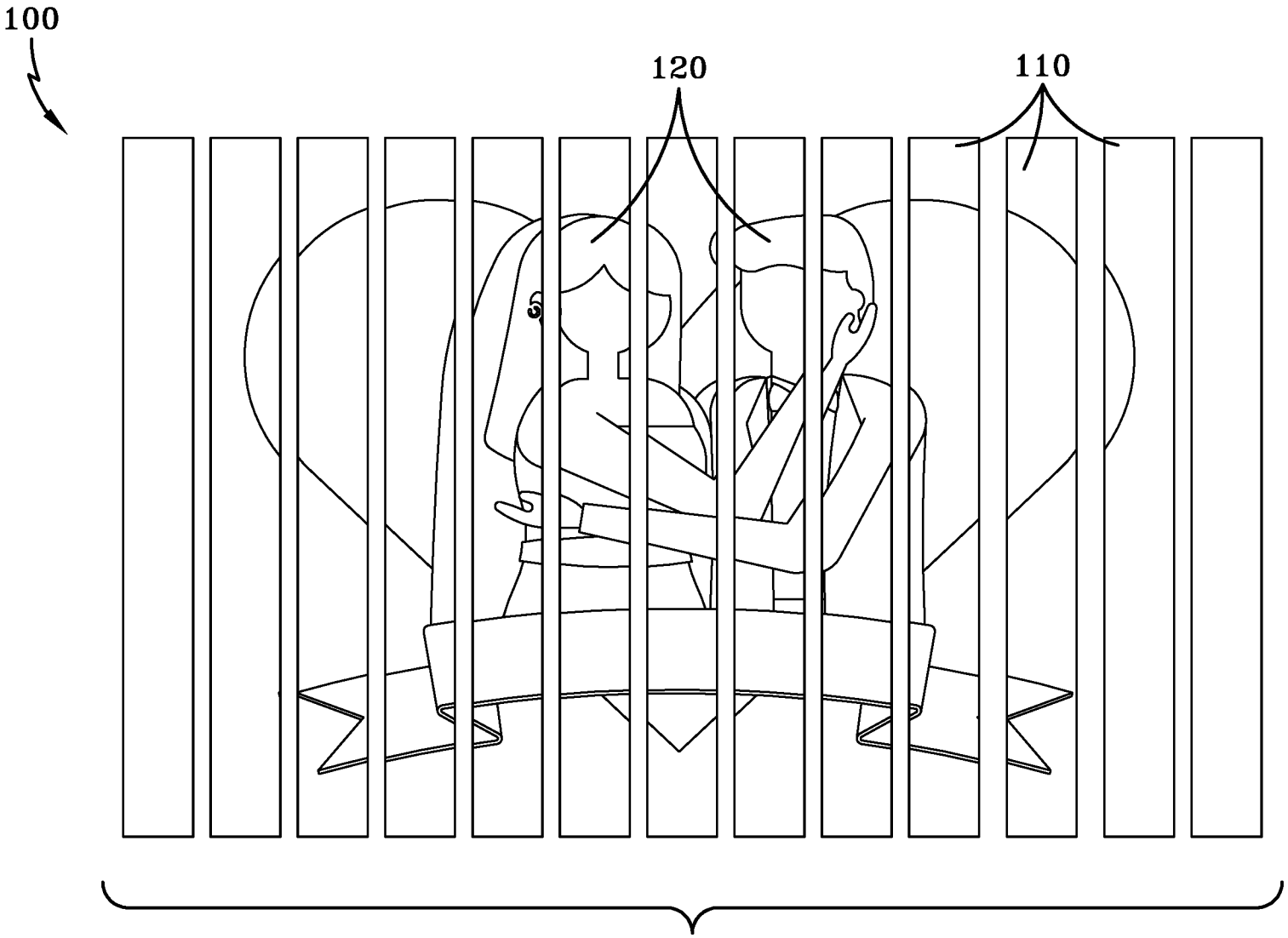
FIG. 4 is an exploded frontal plan view of the decorative panel kit according to the present invention; each panel being spaced from an adjacent panel.
Figure 5:
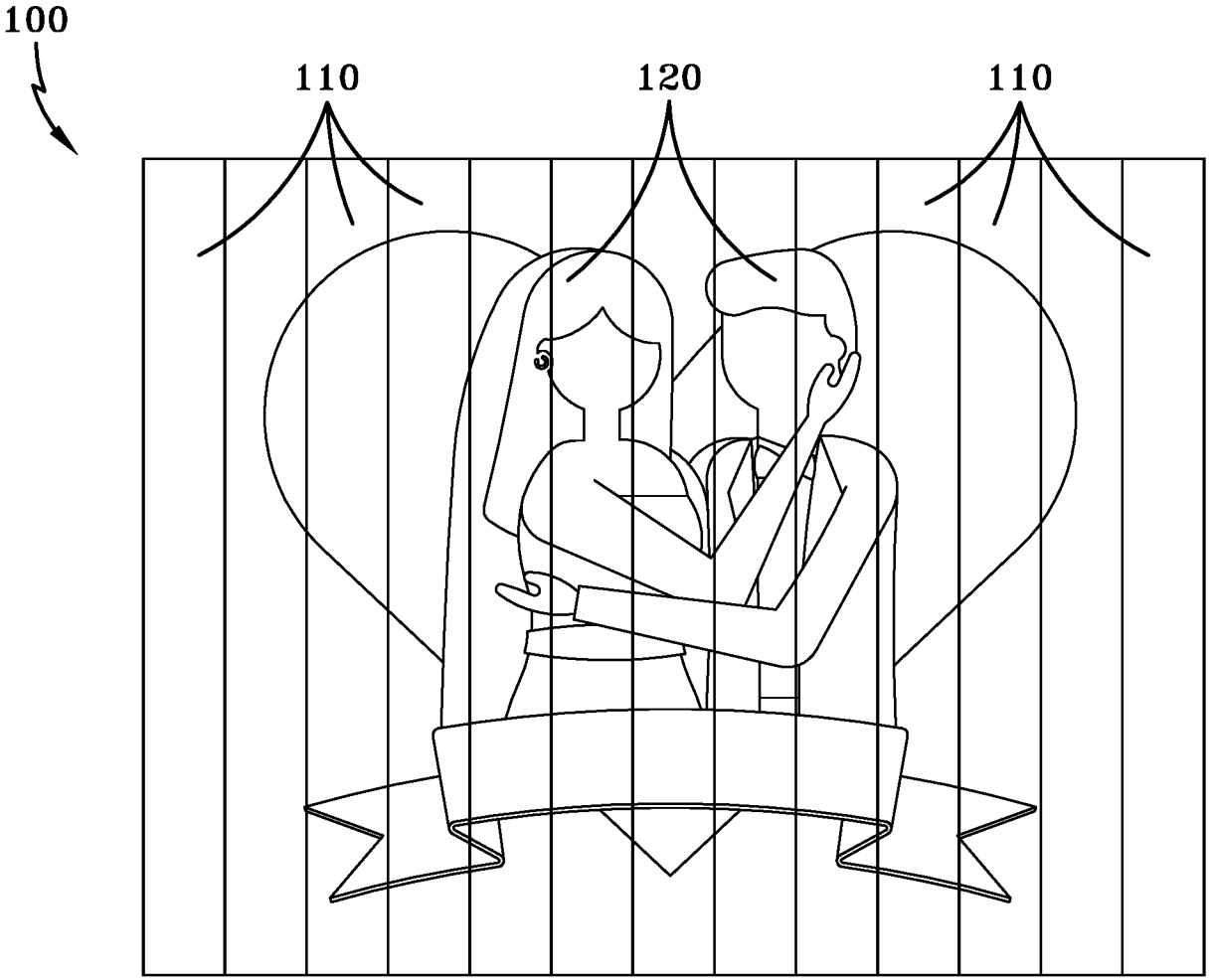
FIG. 5 is a frontal plan view of the adjacent panels shown in abutting relationship along the length at side edges.

FIG. 4 shows the panel kit 100 wherein each panel 110 with a portion of the image 120 is spaced apart in a plan view. FIG. 5 shows the panels 110 pushed together in an abutting relationship along their length. The edges along the sides being pushed together so the complete image 120 can be shown in detail.

Figure 6:
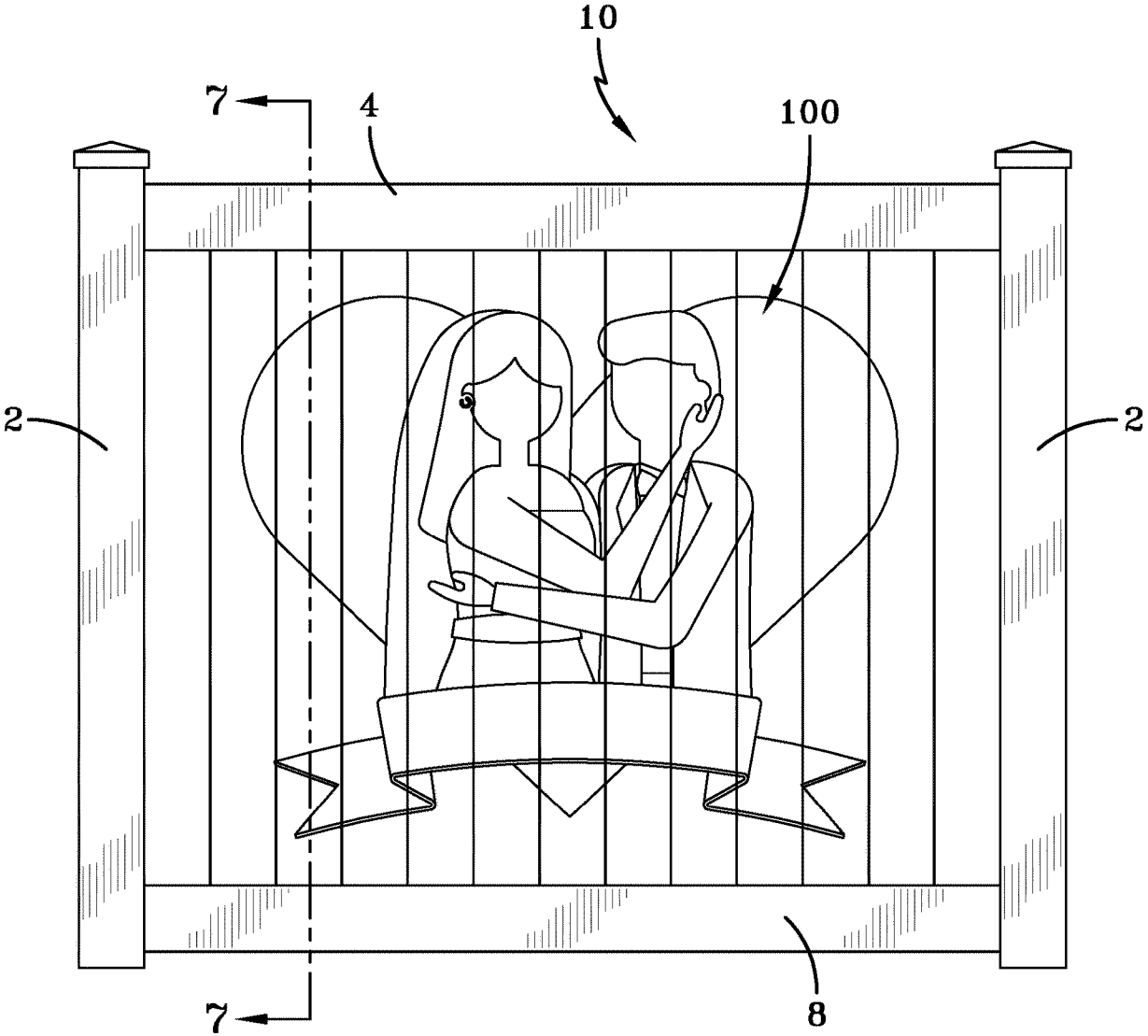
FIG. 6 is a plan view of the kit shown affixed to an exemplary privacy fence section.

With reference to FIG. 6, the kit 100 is shown assembled to a section 10 of privacy fence. The section of privacy fence has a pair of members 4, 8. Each member 4, 8 being designed to hold fence boards 6 and form a section 10 of the privacy fence. At the lateral extremes of these sections 10 are a pair of vertical posts 2. These posts 2 are typically anchored to the ground upon assembly and the sections 10 are mounted between the posts 2 such that the members 4, 8 holding the fence boards 6 are secured to the posts 2 in such a fashion one section 10 of privacy fence is assembled. The next section 10 of privacy fence will then be assembled to the opposite side of the post 2 and this is continued until a completed privacy fence is built around a property.

Figure 7:
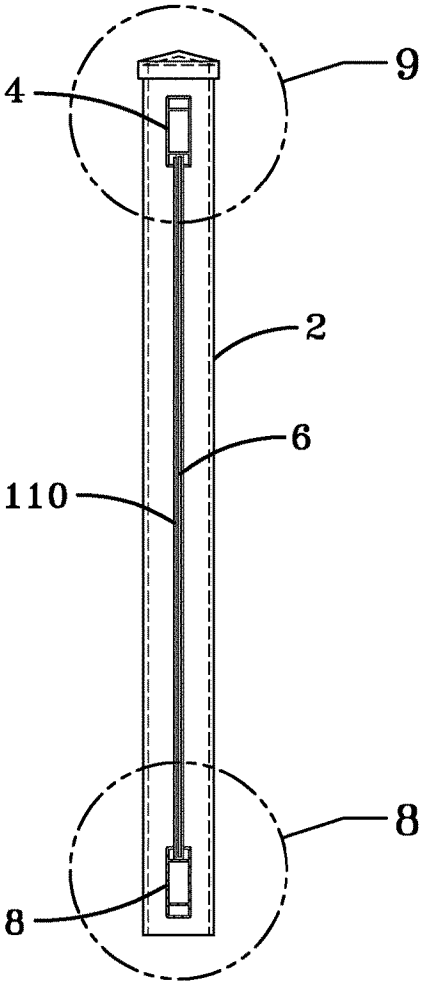
FIG. 7 is a cross-sectional view of the kit affixed to the fence section taken along line 7-7 of FIG. 6.

As shown in FIG. 6, the kit 100, when assembled onto a section 10 of privacy fence is shown to lie with an interior surface against the fence boards 6. The fence boards being positioned within the members 4, 8. As illustrated in FIG. 7, the members include a first or upper member 4 and a second or lower member 8 relative to the ground and the posts 2 are extending vertically lengthwise to form the section 10.

Figure 8:
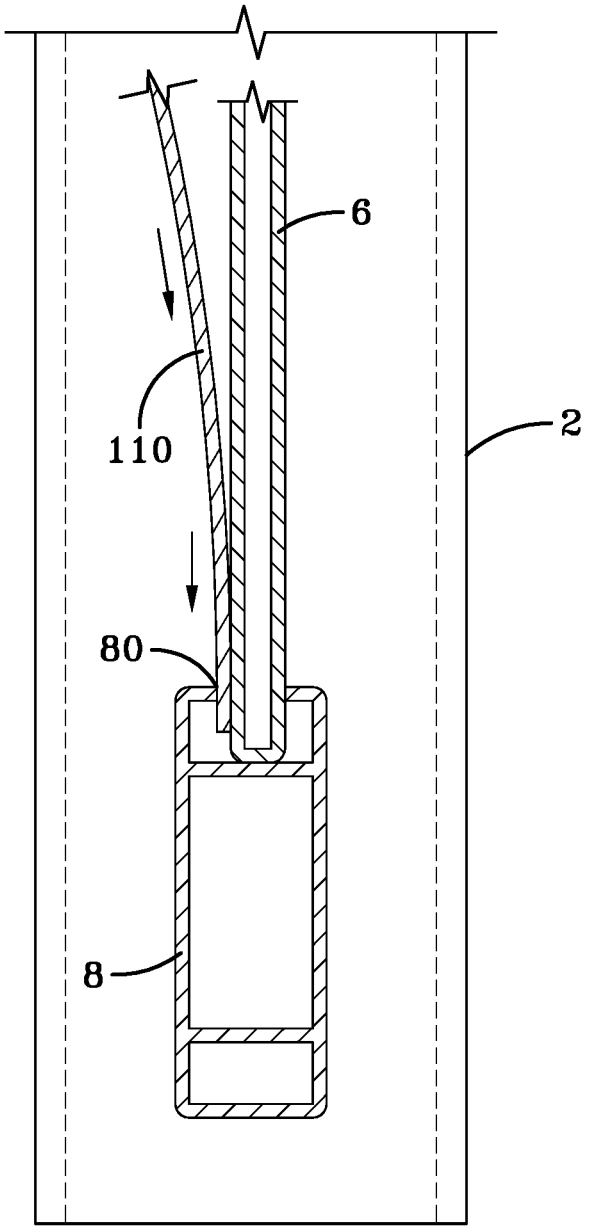
FIG. 8 is an enlarged section view taken from FIG. 7 showing a panel end placed in the space between the second extending member and fence board of the exemplary privacy fence section.
Figure 9:
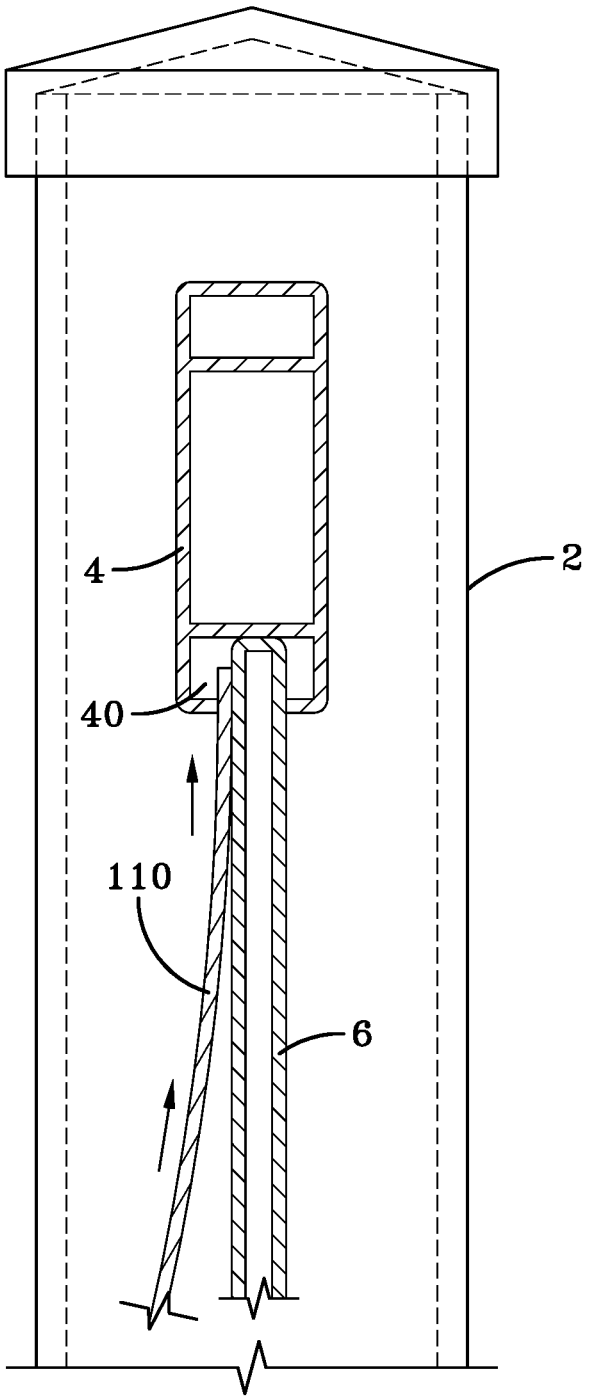
FIG. 9 is an enlarged section view taken from FIG. 7 showing a panel end placed in the space between the first extending member and fence board of the exemplary privacy fence section.

As shown in FIGS. 8 and 9, the ends of the panels 110 are then pushed into a space 40, 80 between the fence board 6 and the member 4, 8 in such a way that the panel 110 is held tightly or snugly between the member 4, 8 and the fence board 6. This is accomplished by flexing the panel 110 slightly so that it will bow sufficiently to allow the ends to slip in the spaces 40, 80 of the first member 4, second member 8 as clearly shown in FIGS. 8 and 9.

In order to make this installation, the user will take the kit 100, open the package, pull the panels 110 out and start by sliding the top of the first panel 110 in the space 40 between the first or upper member 4 and the fence board 6. Then the end of the bottom side of the first panel 110 is then slipped in the space 80 in the second or lower member 8 and the fence board 6. When this occurs, both ends of the panel 110 are securely held between the fence boards 6 and the first and second members 4, 8. To ensure, the panel 110 is flat against the board 6, the panel 110 is pressed slightly against the board 6. This process is repeated until all the panels 110 are installed aligning each panel 110 together so the edges are snugly abutting. Once fully assembled, as illustrated, a complete image 120 will be formed. It is important to understand that these images 120, can be of any user's desire, typically one may consider personal images, such as a photograph or other image, or logos of their favorite teams or sporting activities, or whatever the user chooses to depict on a privacy fence section 10.

In order to insure the panels 110 stay securely and firmly in place, it is possible to spray an adhesive either on the fence board 6 or on the interior side of the panels 110 prior to assembly, or optionally to use a small amount of double-sided tape as needed so each panel 110 can be pressed securely against a fence board 6. This facilitates the panels 110 staying attached to the fence boards 6 and reduces the amount of vibration that can occur due to wind or other issues to dislodge the panels 110 from the fence boards 6.

The panels 110 are preferably made of a synthetic material, thermoplastic. As shown, in a typical example, the panels 110 are made of an expanded polyvinyl chloride, pvc, that is preferably 3.0 mm thick. Alternative materials can be used, however, it has been found that this is a low cost material that provides a superior surface for printing onto.

Figure 10:
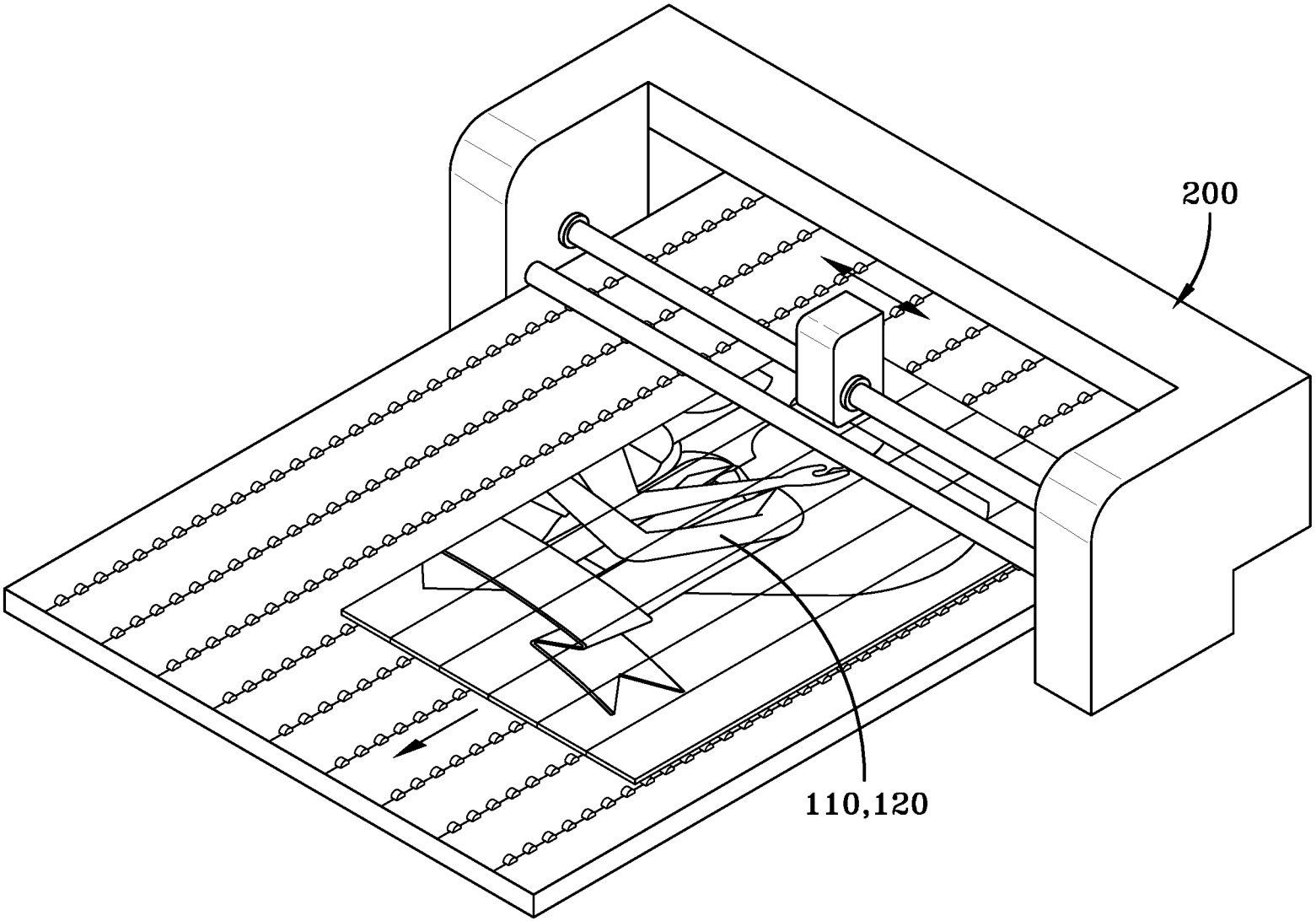
FIG. 10 is a perspective of the kit being printed in a flatbed printer, as shown half of the image is being printed.

With reference to FIG. 10, the image 120 is shown being printed on the panels 110 using a flatbed printer 200. Prior to this step of the manufacturing process, it is important that the panels 110 be cut from size, typically a large sheet of material is taken and the panels 110 are cut in such a fashion that each panel 110 has a width of approximately 6 inches and a height or length subject to the height of the privacy fence to which it will be attached. For example, an 8 foot high privacy fence would have a panel height of 85.75 inches. A 3 foot fence height would have a panel height of 25.75 inches. See the various panel sizes in table 1 for the various sizes of privacy fence. Typically, one of the more common privacy fence sizes is the 6 foot by 6 foot section of privacy fence. In any case, the panel length has to be sufficiently long to extend under each member 4, 8 by preferably ¼ to ½ inch or more.

TABLE 1

| Height (ft) | Panel Height (inches) |
|---|---|
| 8 | 85.75 |
| 7 | 73.75 |
| 6 | 61.75 |
| 5 | 49.75 |
| 4 | 37.75 |
| 3 | 25.75 |

Once the panels 110 are cut to size, they are positioned on the flatbed printer 200 such that the edges are positioned closely together and held in that position as the panels 110 pass through flatbed printer 200, or alternatively, if the flatbed printer 200 has a moveable printing head, the printing head would pass over the panels 110 as they are held in position. The advantage of this type of manufacturing process and printing each discrete panel together as an assembly, allows the panels 110 to be made such that when they separate, there will be no cut edges, there will be no gaps in the image 120. If the image was printed on a single sheet and subsequently cut into panels 110, there would be discrepancies due to the kerf width of the saw blade cutting the panels 110. By doing the printing in a fashion that the discrete panels 110 are placed together as an assembly then printed onto, there is no loss of material or gaps created, therefore, the printing comes out very accurate. As illustrated in FIG. 10, only a portion of the kit 100 has to be printed at one time. Once the first portion of the kit is printed, the flatbed printer 200 is programmed such that a second set of panels 110 can be positioned onto the flatbed and the second part of the image 120 can be printed to complete a full image 120. This provides the manufacturer with the ability to use small flatbed printers 200 to make relatively large decorative panel kits 100. As illustrated, the panel kit 100 is shown with two portions being printed separately. This can be achieved in a single portion where all of the panels 110 are placed together on the flatbed and the entire image 120 is printed in one pass as long as the entire panel kit is sufficiently narrow to allow it to fit on the flatbed printer 200. If alternatively, the image 120 requires multiple passes, this can be done more than two times so virtually any length of kit desired can be created.

Once the image 120 is printed on the panels 110, the kit 100 can then be assembled and packaged. Optionally, the kit 100 can have an adhesive or a double-sided tape applied to the back or interior surface of the panels 110 between the ends of the panels, preferably near the middle of each panel 110. When this is done, a thin releasable film should be put over the adhesive so the respective panel pieces 110 when packaged do not stick together. The adhesive or tape could also be applied at the time of installation.

While the present invention has been shown with the fence boards 6 in a vertical position in a typical privacy fence construction, it is important to note that the fence boards could be placed horizontally, in which case the members 4, 8 instead of being upper or lower, the first and second members 4, 8 would be on left and right sides adjacent the posts 2. In such a fashion, the panels 110 could then be adhered to the horizontal boards 6 or more preferably stuck in between the spaces 40, 80 as previously described, so the ends are secured to the members 4, 8 between the members and fence boards 6 as described earlier except in a horizontal configuration. These alternative variations provide the kit 100 with the versatility of being made either for vertical orientation and placement or for horizontal orientation and placement.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described, which will be within the full intended scope of the invention as defined by the following appended claims. The surgical access window described herein encompasses the dimensions presented and any and all variations applicable to the methods and surgical technique described directly or indirectly intended with this device.

What is claimed is:

1. A method of affixing a decorative panel kit for a privacy fence comprises the steps of:

providing a decorative panel kit having a plurality of panels with portions of an image printed on each panel of the plurality of panels configured to form a complete image when the panels are placed adjacently;

placing a first end of a panel of the plurality of panels in a space between a first member holding fence boards of a privacy fence section and the fence boards and placing a second end of the panel in a space between a second member holding the fence boards and the fence boards wherein the portion of the image is exterior relative to the fence boards and visible;

repeating by placing a next panel adjacent a previous panel with the first and second ends held in the spaces until all the panels are positioned onto and secured to the privacy fence section with the complete image being formed by the assembly of the plurality of panels; and wherein each panel is a rectangular sheet of material having a length, a width, edges and a thickness and each panel is sized with a length (L) extending from a first end to a second end and portions of the length adjacent the ends are configured to fit into a space formed in a privacy fence section between extending members and fence boards to hold the panels in place, the extending members include a first member and a second member, the first and second members hold a plurality of fence boards to form the privacy fence sections; and wherein the end portions of the length of each panel are held in the space between the first and second members and the fence boards and edges along the length of each adjacent panel abut with the interior surface lying against the fence boards to complete the attachment of the assembled plurality of panels to the privacy fence.

2. A method of affixing a decorative panel kit for privacy fences of claim 1, wherein the step of providing a decorative panel kit includes the steps of:

providing a thin sheet of panel material and cutting the panel material into a plurality of panels, each panel having a width, a length, edges and a thickness;

aligning the panels along their respective lengths at abutting edges to form a first plurality of adjacent panels;

holding the first plurality of adjacent panels and either passing the first plurality of adjacent panels through a flatbed printer or passing the flatbed printer over the held first plurality of adjacent panels; and printing a full image or at least a first portion of an image on an exterior surface of the first plurality of adjacent panels.

3. The method of claim 2 further comprises:

providing additional panels having the width, the length, the edges and thickness;

aligning the additional panels along their respective lengths at abutting edges to form a second plurality of adjacent panels;

holding the second plurality of adjacent cut panels and passing through a flatbed printer or passing the flatbed printer over the held second plurality of adjacent panels; and printing a second portion of the image on an exterior surface of the second plurality of adjacent panels, the second portion of the image complimentarily forms a complete image when aligned with the printed exterior surface of the first plurality of adjacent panels.

4. The method of claim 3 wherein the steps of providing additional panels are repeated to allow complete images of larger sizes to be made.

5. The method of claim 2 wherein the panels after printing are assembled and packaged to form a decorative panel kit.

6. The method of claim 2 further comprises the step of applying an adhesive coating or double-sided tape to an interior surface of each panel opposite the surface with the printed image and covering the adhesive with a releasable film prior to packaging the decorative panel kit.

7. The method of claim 1 further comprises centering the image by locating a center of the privacy fence section, taking a first panel of the plurality of panels and positioning a leading edge of the first panel a distance of half the width of the entire panel kit from the center on a fence board of the privacy fence section so a center of the complete image will substantially align with the center of the privacy fence section.

8. The method of claim 7 wherein the step of placing the ends of the panels between the members holding the fence boards and the fence boards further comprises positioning the ends in the space between the member and the fence board thereby holding each panel and the panels have a thickness configured to fit into the space.

9. The method of claim 8 further comprises holding the panels at the ends and wherein an interior surface of the panel lies against the fence board.

10. The method of claim 9 further comprises the steps of:

providing the interior surface of each panel with an adhesive or applying an adhesive to an interior surface of each panel and pressing the panel against the fence board to adhesively hold the panel against the fence board.

11. The method of claim 10 wherein the adhesive is a spray on or double-sided tape.

12. The method of claim 10 wherein the panels are held at each end and between the ends along at least portions of the interior surface by adhesives.

13. The method of claim 1 wherein the panels are oriented parallel to the fence boards and transverse to the members of the privacy fence.

14. The method of claim 1 wherein the panels and fence boards are oriented vertically relative to the privacy fence.

* * * * *